US007775811B2

(12) United States Patent
Lai et al.

(10) Patent No.: US 7,775,811 B2
(45) Date of Patent: Aug. 17, 2010

(54) CIRCUIT BOARD MODULE AND CONNECTOR PROTECTING COVER THEREOF

(75) Inventors: Chih-Ming Lai, Taipei County (TW); Yung-Shun Kao, Taipei County (TW)

(73) Assignee: Giga-Byte Technology Co., Ltd., Taipei Hsien, Taiwan (CN)

( * ) Notice: Subject to any disclaimer, the term of this patent is extended or adjusted under 35 U.S.C. 154(b) by 19 days.

(21) Appl. No.: 12/289,307

(22) Filed: Oct. 24, 2008

(65) Prior Publication Data

US 2010/0105228 A1 Apr. 29, 2010

(51) Int. Cl.
*H01R 13/44* (2006.01)

(52) U.S. Cl. ..... 439/135; 439/149

(58) Field of Classification Search ..... 439/135, 439/148, 149, 940
See application file for complete search history.

(56) References Cited

U.S. PATENT DOCUMENTS 5,026,295 A * 6/1991 Fong et al. ..... 439/135
5,242,311 A 9/1993 Seong
6,979,211 B1 12/2005 Shen
2006/0134952 A1 6/2006 Meister et al.

FOREIGN PATENT DOCUMENTS

DE 20 2004 017 147 U1 5/2005
EP 0060644 A1 9/1982
EP 0405838 A2 1/1991
EP 1139501 A2 10/2001

* cited by examiner

*Primary Examiner*—Khiem Nguyen
(74) *Attorney, Agent, or Firm*—Birch, Stewart, Kolasch & Birch, LLP

(57) ABSTRACT

A connector protecting cover and a circuit board module using the same are provided. The circuit board module includes a circuit board, a plurality of electronic devices, a connector, and a connector protecting cover. The electronic devices are disposed on the circuit board. The connector is disposed on the circuit board and includes a plurality of connecting terminals connected to the circuit board. The connector protecting cover includes a top wall, a circular side wall connected to the top wall, and a partition. The partition is connected to the circular side wall. The top wall, the circular side wall, and the partition define a plurality of accommodation spaces. The partition and the circular side wall are together used for clipping the connecting terminals, such that the connecting terminals are located in the accommodation spaces.

16 Claims, 3 Drawing Sheets

CIRCUIT BOARD MODULE AND CONNECTOR PROTECTING COVER THEREOF

BACKGROUND OF THE INVENTION

1. Field of the Invention

The present invention relates to a protecting cover and a circuit board module, in particular, to a connector protecting cover and a circuit board module using the same.

2. Description of Related Art

With the progress of technologies and the popularization of computer systems, more and more modern people are getting used to utilizing computer systems to deal with documents, browse websites, play audio and video files, or store data. In this way, computer systems have become one of the indispensable tools for the modern people in daily life or work.

Both the desktop computer and the notebook computer are provided with a circuit board, and the circuit board is configured with different types of electronic devices thereon to realize different functions. In addition, the circuit board is usually configured with connectors for connecting to computer peripherals such as keyboard, mouse, and portable flash drive. Some connector may be connected to a connection receptacle on a case of the computer through a transmission cable, and then the peripherals are connected to the connector through the connection receptacle.

The common connectors include a USB connector and a 1394 connector. The two types of connectors have different voltages, but they are quite similar in structure and appearance. As a result, a computer assembling personnel or a user may easily insert an incorrect transmission cable by mistake, so that the peripherals connected to the connector may be damaged due to an incorrect voltage.

SUMMARY OF THE INVENTION

Accordingly, the present invention is directed to a connector protecting cover, suitable for being fixed to cover a connector on a circuit board.

The present invention is also directed to a circuit board module with a connector protecting cover.

As embodied and broadly described herein, the present invention provides a connector protecting cover, which is suitable for being fixed to a connector of a circuit board module to cover a plurality of connecting terminals of the connector. The connector protecting cover includes a top wall, a circular side wall, and a partition. The circular side wall is connected to the top wall. The partition is connected to the circular side wall. The top wall, the circular side wall, and the partition define a plurality of accommodation spaces. The partition and the circular side wall are together used for clipping the connecting terminals, such that the connecting terminals are located in the accommodation spaces.

In the connector protecting cover according to an embodiment of the present invention, an outer surface of the circular side wall is provided with at least one rib for being snapped in a notch of an outer frame of the connector.

In the connector protecting cover according to an embodiment of the present invention, an outer surface of the circular side wall is provided with a plurality of protruding ridges for bearing against an outer frame of the connector, and each of the protruding ridges has a guide chamfer on one side far away from the top wall.

The present invention further provides a circuit board module, which includes a circuit board, a plurality of electronic devices, a connector, and a connector protecting cover. The electronic devices are disposed on the circuit board. The connector is disposed on the circuit board and includes a plurality of connecting terminals connected to the circuit board. The connector protecting cover includes a top wall, a circular side wall connected to the top wall, and a partition. The partition is connected to the circular side wall. The top wall, the circular side wall, and the partition define a plurality of accommodation spaces. The partition and the circular side wall are together used for clipping the connecting terminals, such that the connecting terminals are located in the accommodation spaces.

In an embodiment of the present invention, a width of each of the accommodation spaces is substantially equal to a thickness of each of the connecting terminals.

In an embodiment of the present invention, an outer surface of the circular side wall is provided with at least one rib, the connector further includes an outer frame with a notch disposed thereon, and the rib is snapped in the notch of the outer frame.

In an embodiment of the present invention, an outer surface of the circular side wall is provided with a plurality of protruding ridges, the connector further includes an outer frame, and the protruding ridges are used to bear against the outer frame. Each of the protruding ridges has a guide chamfer on one side far away from the top wall.

In an embodiment of the present invention, the circular side wall is a square circular side wall.

In an embodiment of the present invention, a portion of the circular side wall adjacent to the top wall forms an acute angle with the top wall.

In an embodiment of the present invention, the partition is connected to the top wall.

In an embodiment of the present invention, an outer surface of the top wall has an identifier.

In an embodiment of the present invention, the connector further includes a base, disposed on the circuit board, for wrapping one end of each connecting terminal close to the circuit board.

In an embodiment of the present invention, the connector is a 1394 connector or a USB connector.

In the connector protecting cover and the circuit board module of the present invention, the connector protecting cover may be fixed to cover the connector on the circuit board, so as to prevent a computer assembling personnel or a user from carelessly inserting an incorrect device into the connector.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
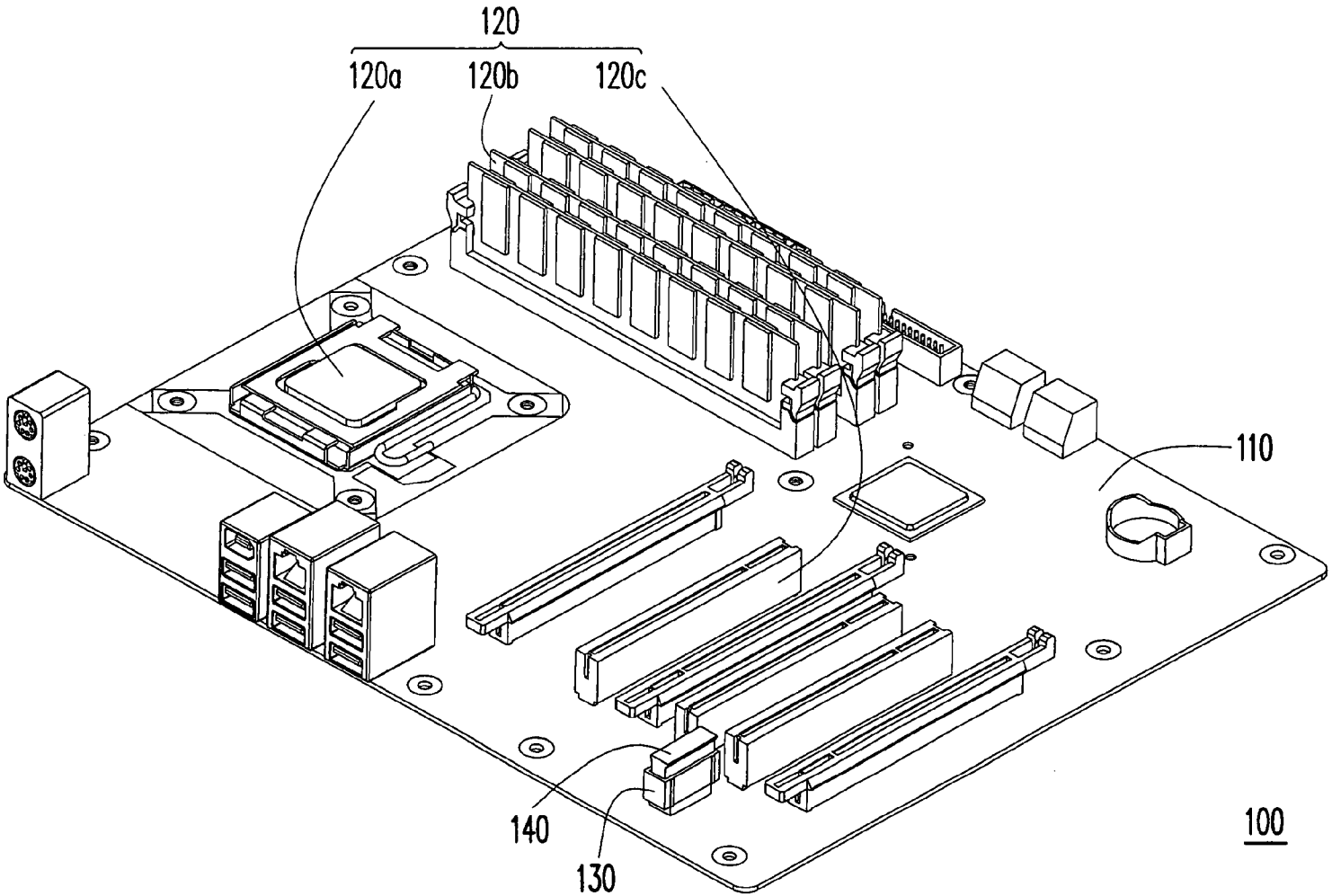
FIG. 1 is a three-dimensional view of a connector protecting cover applied in a circuit board module according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

FIG. 1 is a three-dimensional view of a connector protecting cover applied in a circuit board module according to an embodiment of the present invention. Referring to FIG. 1, a circuit board module 100 in this embodiment includes a circuit board 110, a plurality of electronic devices 120, a connector 130, and a connector protecting cover 140. The electronic devices 120 are disposed on the circuit board 110. The connector 130 is disposed on the circuit board 110.

The electronic devices 120 of the circuit board module 100 includes, for example, a central processing unit (CPU) 120*a*, a memory 120*b*, an interface card socket 120*c*, and the circuit board module 100 further includes components such as a heat sink or a heat dissipation fan (not shown) disposed on the circuit board 110.

Figure 2A:
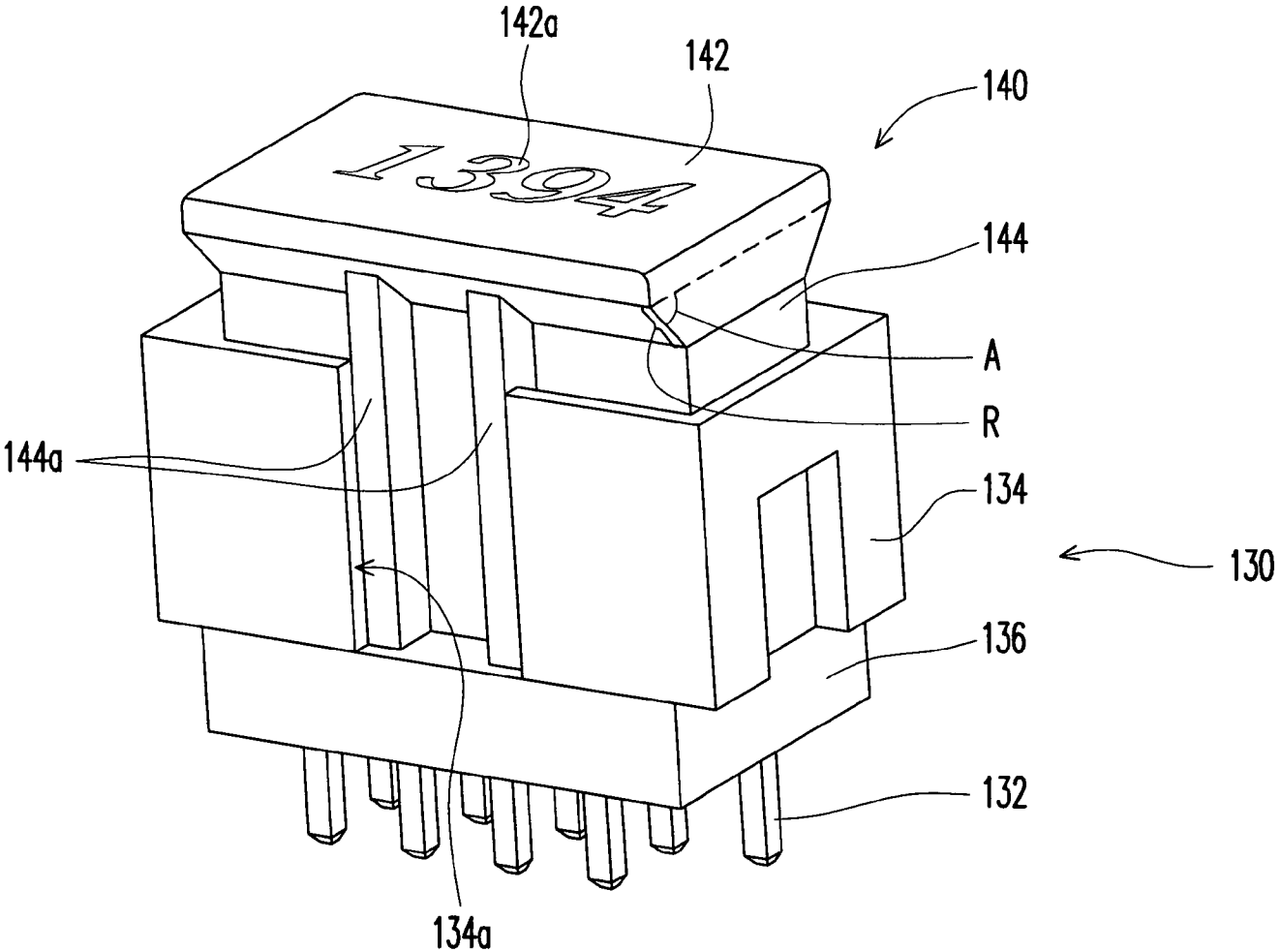
FIG. 2A is a three-dimensional view of the connector protecting cover and the connector in FIG. 1.
Figure 2B:
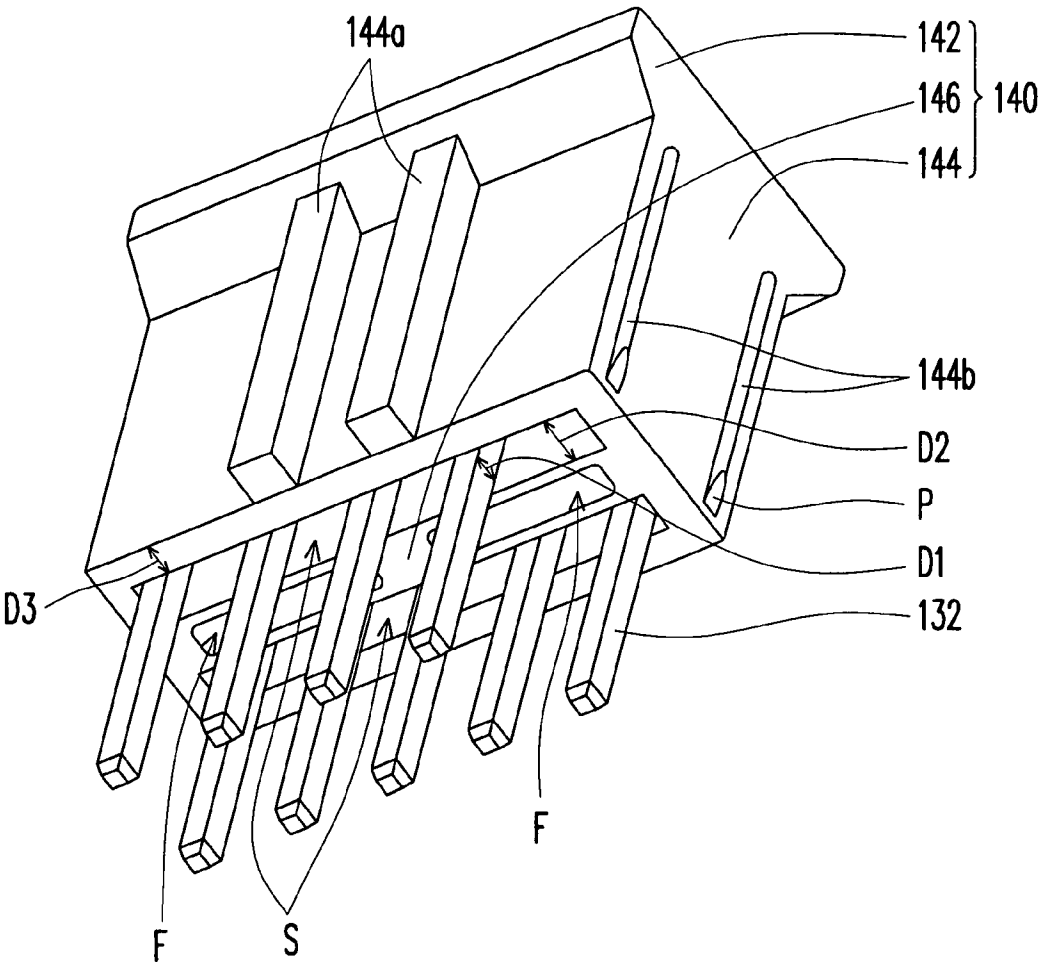
FIG. 2B is a three-dimensional view of the connector protecting cover and partial of the connector in FIG. 1.

FIG. 2A is a three-dimensional view of the connector protecting cover and the connector in FIG. 1, and FIG. 2B is a three-dimensional view of the connector protecting cover and partial of the connector in FIG. 1. Referring to FIGS. 2A and 2B, the connector 130 includes a plurality of connecting terminals 132 connected to the circuit board 110 (shown in FIG. 1). The connector protecting cover 140 includes a top wall 142, a circular side wall 144 connected to the top wall 142, and a partition 146.

The partition 146 is connected to the circular side wall 144. The top wall 142, the circular side wall 144, and the partition 146 define a plurality of accommodation spaces S. The partition 146 and the circular side wall 144 are together used for clipping the connecting terminals 132, such that the connecting terminals 132 are located in the accommodation spaces S.

Referring to FIG. 2A, in this embodiment, an outer surface of the circular side wall 144 is provided with at least one rib 144*a* (two ribs are shown). The connector 130 further includes an outer frame 134 with a notch 134*a* disposed thereon. The rib 144*a* is snapped in the notch 134*a* of the outer frame 134, so that the direction for fixing the connector protecting cover 140 to the connector 130 is limited through a structural interference. Therefore, the connecting terminals 132 can be protected from being damaged due to the incorrect direction for fixing the connector protecting cover 140 to the connector 130.

The connector 130 further includes a base 136 disposed on the circuit board 110 and used for wrapping one end of each connecting terminal 132 close to the circuit board 110. Moreover, the outer frame 134 and the base 136 may be integrally formed through an injection moulding process.

An outer surface of the top wall 142 is provided with an identifier 142*a* for the user to identify the type of the connector 130 covered by the connector protecting cover 140, and the connector 130 is, for example, a 1394 connector or a universal serial bus (USB) connector. In this embodiment, a portion R of the circular side wall 144 adjacent to the top wall 142 forms an acute angle A with the top wall 142, such that the connector protecting cover 140 is formed into a T-like shaped structure. Therefore, the user can easily take the connector 130 from the connector protecting cover 140.

Referring to FIG. 2B, in this embodiment, the circular side wall 144 is a square circular side wall, and the partition 146 may be connected to both the top wall 142 and the circular side wall 144 or merely connected to the circular side wall 144. A width D2 of each of the accommodation spaces S is substantially equal to a thickness D1 of each of the connecting terminals 132, such that the partition 146 and the circular side wall 144 are together used for clipping the connecting terminals 132. Moreover, the partition 146 has a plurality of grooves F, so that the usage of the material may be saved during the injection moulding process for producing the connector protecting cover 140.

It should be noted that, since the connector protecting cover 140 is fixed to the connector 130 by clipping the connecting terminals 132, instead of being fixed to the connector 130 through the outer frame 134 or the base 136, the connector protecting cover 140 is also applicable to a connector without the outer frame 134 and the base 136.

In this embodiment, an outer surface of the circular side wall 144 is provided with a plurality of protruding ridges 144*b*, and each protruding ridge 144*b* has a guide chamfer P on one side far away from the top wall 142. The guide chamfer P has a guiding function, such that the connector protecting cover 140 can be easily fixed to the connector 130. The protruding ridges 144*b* are used to bear against the outer frame 134 (shown in FIG. 2A), such that the connector protecting cover 140 and the connector 130 may be combined tightly through a flexible deformation.

Based on the above, the connector protecting cover of the circuit board module in the present invention may be fixed to cover the connector on the circuit board. Therefore, the computer assembling personnel or the user is prevented from inserting an incorrect transmission device into the connector by mistake, and the possibility of damaging the computer peripherals connected to the connector due to an incorrect voltage is reduced as well.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A connector protecting cover, suitable for being fixed to a connector of a circuit board module to cover a plurality of connecting terminals of the connector, the connector protecting cover comprising:

a top wall;

a circular side wall, connected to the top wall; and a partition, connected to the circular side wall, wherein the top wall, the circular side wall, and the partition define a plurality of accommodation spaces, the partition and the circular side wall are together used for clipping the connecting terminals, such that the connecting terminals are located in the accommodation spaces, an outer surface of the circular side wall is provided with a plurality of protruding ridges for bearing against an outer frame of the connector, and each of the protruding ridges comprises a guide chamfer on one side far away from the top wall.

2. The connector protecting cover according to claim 1, wherein a width of each of the accommodation spaces is substantially equal to a thickness of each of the connecting terminals.

3. The connector protecting cover according to claim 1, wherein an outer surface of the circular side wall is provided with at least one rib for being snapped in a notch of an outer frame of the connector.

4. The connector protecting cover according to claim 1, wherein the circular side wall is a square circular side wall.

5. The connector protecting cover according to claim 1, wherein a portion of the circular side wall adjacent to the top wall forms an acute angle with the top wall.

6. The connector protecting cover according to claim 1, wherein the partition is connected to the top wall.

7. The connector protecting cover according to claim 1, wherein an outer surface of the top wall is provided with an identifier.

8. A circuit board module, comprising:

a circuit board;

a plurality of electronic devices, disposed on the circuit board;

a connector, disposed on the circuit board and comprising a plurality of connecting terminals connected to the circuit board; and a connector protecting cover, comprising:

a top wall;

a circular side wall, connected to the top wall; and a partition, connected to the circular side wall, wherein the top wall, the circular side wall, and the partition define a plurality of accommodation spaces, the partition and the circular side wall are together used for clipping the connecting terminals, such that the connecting terminals are located in the accommodation spaces, an outer surface of the circular side wall is provided with a plurality of protruding ridges, the connector further comprises an outer frame, the protruding ridges are used to bear against the outer frame, and each of the protruding ridges is provided with a guide chamfer on one side far away from the top wall.

9. The circuit board module according to claim 8, wherein a width of each of the accommodation spaces is substantially equal to a thickness of each of the connecting terminals.

10. The circuit board module according to claim 8, wherein an outer surface of the circular side wall is provided with at least one rib, the connector further comprises an outer frame with a notch, and the rib is snapped in the notch of the outer frame.

11. The circuit board module according to claim 8, wherein the circular side wall is a square circular side wall.

12. The circuit board module according to claim 8, wherein a portion of the circular side wall adjacent to the top wall forms an acute angle with the top wall.

13. The circuit board module according to claim 8, wherein the partition is connected to the top wall.

14. The circuit board module according to claim 8, wherein an outer surface of the top wall is provided with an identifier.

15. The circuit board module according to claim 8, wherein the connector further comprises a base, disposed on the circuit board, for wrapping one end of each connecting terminal close to the circuit board.

16. The circuit board module according to claim 8, wherein the connector is a 1394 connector or a USB connector.

* * * * *